US005408303A

United States Patent [19]

Fukunaga et al.

[11] Patent Number: 5,408,303

[45] Date of Patent: Apr. 18, 1995

[54] POSITIONING MECHANISM FOR A CLEANING DEVICE PROVIDED IN AN IMAGE FORMING APPARATUS

[75] Inventors: Yasuyuki Fukunaga, Hirakata; Hideki Kita, Suita; Akira Nakakuma, Izumi; Toshimitsu Takeuchi, Hirakata, all of Japan

[73] Assignee: Mita Industrial Co., Ltd., Osaka, Japan

[21] Appl. No.: 982,310

[22] Filed: Nov. 27, 1992

[30] Foreign Application Priority Data

Nov. 29, 1991 [JP] Japan ..... 3-317117

[51] Int. Cl.[6] ..... G03G 21/00

[52] U.S. Cl. ..... 355/299; 355/296

[58] Field of Search ..... 355/296, 297, 298, 299, 355/301; 118/652

[56] References Cited

U.S. PATENT DOCUMENTS

| | | | |
|---|---|---|---|
| 4,451,139 | 5/1984 | Yanagawa | 355/297 |
| 4,595,280 | 6/1986 | Tanzawa et al. | 355/299 |
| 4,908,671 | 3/1990 | Kusumoto | 355/298 |
| 4,969,015 | 11/1990 | Sanpe | 355/297 |

FOREIGN PATENT DOCUMENTS

| | | | |
|---|---|---|---|
| 56-165179 | 12/1981 | Japan . | |
| 0040678 | 3/1984 | Japan | 355/299 |
| 59-064881 | 4/1984 | Japan . | |
| 0020974 | 1/1986 | Japan | 355/299 |
| 0138379 | 6/1988 | Japan | 355/299 |
| 2216069 | 10/1989 | United Kingdom . | |

OTHER PUBLICATIONS

Xerox Disclosure Journal, *Removable Cleaner Housing*, McCarroll, vol. 8, No. 5, Sep./Oct. 1983, p. 433.

*Primary Examiner*—Robert B. Beatty

*Attorney, Agent, or Firm*—Renner, Otto, Boisselle & Sklar

[57] ABSTRACT

A housing accommodating a fur brush and a cleaning blade is pivoted to a position close to a photoconductive drum and at another position far from the photoconductive drum by positioning a positioning shaft. When the positioning shaft is slid for moving the positioning shaft away from a photoconductive drum, an operating member attached to the positioning shaft is put into contract with a pivoting lever to raise the pivoting lever away from the photoconductive drum. Since the pivoting lever is attached to a blade shaft, a cleaning blade attached to the blade shaft is pivoted away from the photoconductive drum.

6 Claims, 3 Drawing Sheets

POSITIONING MECHANISM FOR A CLEANING DEVICE PROVIDED IN AN IMAGE FORMING APPARATUS

BACKGROUND OF THE INVENTION

1. Field of the Invention

The present invention relates to a positioning mechanism for positioning a cleaning device in a main body of an image forming apparatus such as a copier, a printer and the like, the cleaning device being provided for cleaning a photoconductive surface of the image forming apparatus.

2. Description of the Related Art

In an electrophotographic copier, after a toner image is formed on a photoconductive drum and transferred onto a paper, unnecessary toner adhered on a surface the photoconductive drum is removed by a cleaning device. Today, the efficiency of the cleaning device is improved by a system in which a fur brush cleans the surface before a blade is slid along the surface to scratch off the toner adhered thereon.

The blade and the fur brush of the cleaning device should be kept off the surface of the photoconductive drum when the image forming apparatus is not in operation, for example, during transportation and storage, in order to protect the surface of the photoconductive drum from being damaged. This is realized by setting the whole cleaning device at a position distanced from the photoconductive drum.

In order to set the cleaning device as mentioned above, a complicated mechanism is required for moving the whole cleaning device, and further, setting the cleaning device at a specified position is not easy. Moreover, since a driving force for rotating the fur brush is conveyed through gears from a driving system of a main body of the image forming apparatus, it is possible that the gears are not accurately engaged with each other when the cleaning device is not set exactly at the specified position.

SUMMARY OF THE INVENTION

A positioning mechanism for a cleaning device according to the present invention includes a housing supported at a top portion thereof by a supporting shaft parallel to a photoconductive drum of an image forming apparatus, to be pivotal about the supporting shaft with respect to a main body of the image forming apparatus; a blade shaft supported in the housing to be parallel to the photoconductive drum and to be pivotal with respect to the housing; a cleaning blade attached to the blade shaft to be opposed to a circumferential surface of the photoconductive drum; a brush member provided in the housing to be parallel to the cleaning blade in a rotating direction of the photoconductive drum and to be integrally pivotal with the housing; a positioning device for controllably positioning the housing at a position close to the photoconductive drum and at another position far from the photoconductive drum; and a moving device for moving the blade shaft away from the photoconductive drum when the housing is positioned to the position far from the photoconductive drum by the positioning device.

According to a positioning mechanism for a cleaning device according to the present invention, a housing is pivoted to and thus positioned at a position close to a photoconductive drum or at another position far from the photoconductive drum by a positioning device.

Such pivoting of the housing puts a cleaning blade and a brush member into contact with or out of contact from the photoconductive drum. When the housing is distanced from the photoconductive drum by the positioning device, a blade shaft supporting the cleaning blade is separated further away from the photoconductive drum by a moving device.

Thus, the invention described herein makes possible an advantage of providing a positioning mechanism which puts a blade and a fur brush of a cleaning device into contact with or out of contact from an outer circumferential surface of a photoconductive drum in a simple construction.

These and other advantages of the present invention will become apparent to those skilled in the art upon reading and understanding the following detailed description with reference to the accompanying figures.

DESCRIPTION OF THE PREFERRED EMBODIMENTS

Hereinafter, the present invention will be described by way of illustrating examples with reference to the accompanying drawings.

Figure 1:
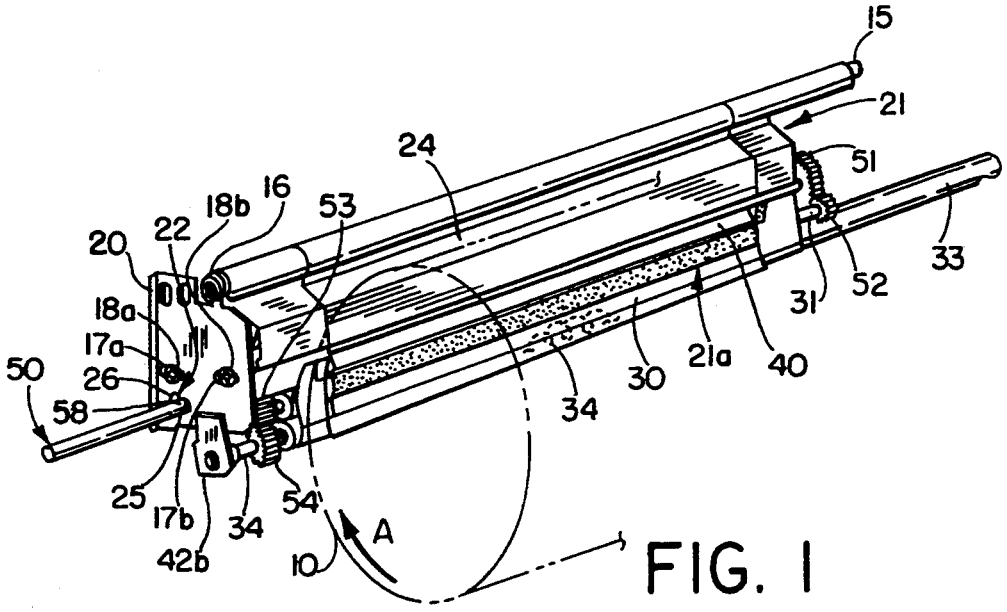
FIG. 1 is a perspective view of an example of a cleaning device according to the present invention.

A cleaning device having a positioning mechanism according to the present invention is attached to, for example, an electrophotographic copier. As is shown in FIG. 1, the cleaning device includes a housing 21 provided in the vicinity of a photoconductive drum 10 which is rotated in a direction of an arrow A. The housing 21 has an opening 21*a* opposed to the photoconductive drum 10, and an upper portion of the opening 21*a* is covered with a cover 24 detachable from the housing 21.

The housing 21 accommodates a cleaning blade 40 and a fur brush 30 therein. The cleaning blade 40 is extended outside the opening 21*a* below the cover 24 to slide along a surface of the photoconductive drum 10. The fur brush 30 is rotated against the surface of the photoconductive drum 10 upstream from the cleaning blade 40 in the direction of the arrow A. A toner image is formed on the surface of the photoconductive drum 10, and then is transferred onto a paper. After that, the surface of the photoconductive drum 10 is cleaned by the fur brush 30 and the cleaning blade 40. Below the fur brush 30, a receiving blade (not shown) formed of a flexible material covers a lower part of the opening. The toner removed by the fur brush 30 and the cleaning blade 40 is guided into the housing 21 by the receiving blade.

Figure 3:
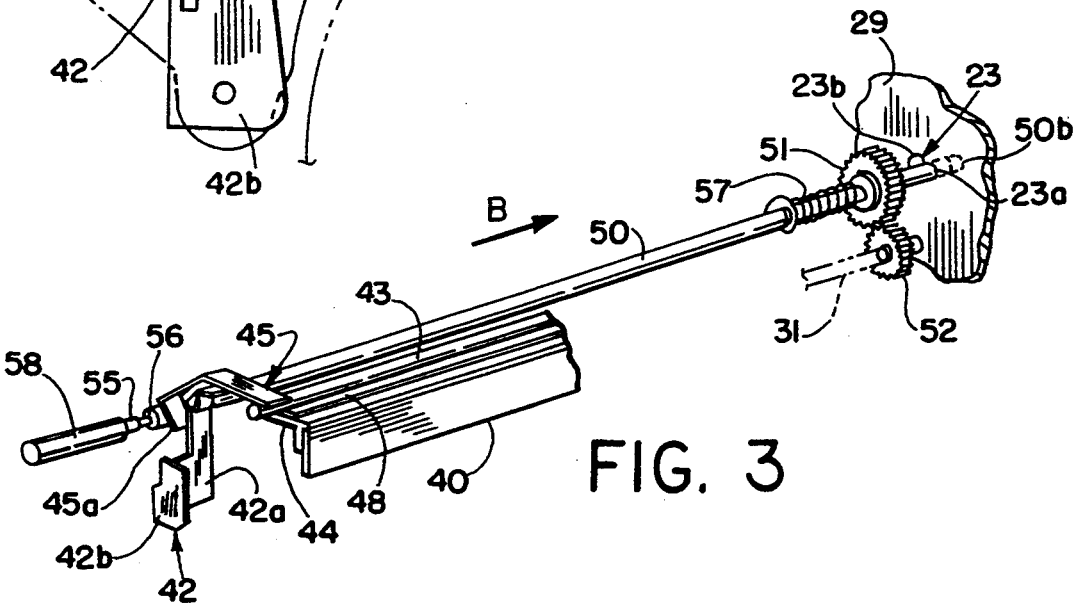
FIG. 3 is a perspective view of an essential part of the cleaning device of FIG. 1.

The housing 21 is supported to a main body of the copier by a supporting shaft 15. The supporting shaft 15 is provided parallel to the photoconductive drum 10 and is inserted throughout a top portion of the housing 21. Both ends of the supporting shaft 15 are extended from the housing 21. One of the ends which is close to a front face of the copier is rotatably supported to a fixed plate 20 through screw 16. The other end of the supporting shaft 15 which is close to a rear face of the copier is supported by a rear plate 29 (FIG. 3). In this specification, the side of the fixing plate 20 is referred to as "front", and the side of the rear plate 29 is referred to as "rear".

The fixed plate 20 has a pair of slots 17*a* and 17*b* in a middle part thereof. The slots 17*a* and 17*b* are extended on an arc of an identical circle around an axis of the supporting shaft 15. The slot 17*a* is farther from the photoconductive drum 10 than the slot 17*b*. Screws 18*a* and 18*b* are slidably engaged with the slots 17*a* and 17*b* and attached to a front face of the housing 21.

The fur brush 30 provided parallel to the photoconductive drum 10 has a rotation shaft 31 running throughout an axis thereof. Both ends of the rotation shaft 31 are supported by the faces of the housing 21. In more detail, a front end of the rotation shaft 31 is inserted through the front face of the housing 21 and supported by the fixed plate 20. A rear end of the rotation shaft 31 is inserted through a rear face of the housing 21 and supported by the rear plate 29. A surface of the fur brush 30 can be put into contact with the surface of the photoconductive drum 10.

Below the fur brush 30, the housing 21 accommodates a spiral conveyer 34 for transferring the toner removed by the fur brush 30 and the cleaning blade 40 in an axial direction of the fur brush 30. A front end of the spiral conveyor 34 is supported by a stopper 42*b* of an operating member 42 described later. A rear end of the spiral conveyor 34 is connected to a discharge pipe 33 inserted through the rear plate 29.

Figure 2:
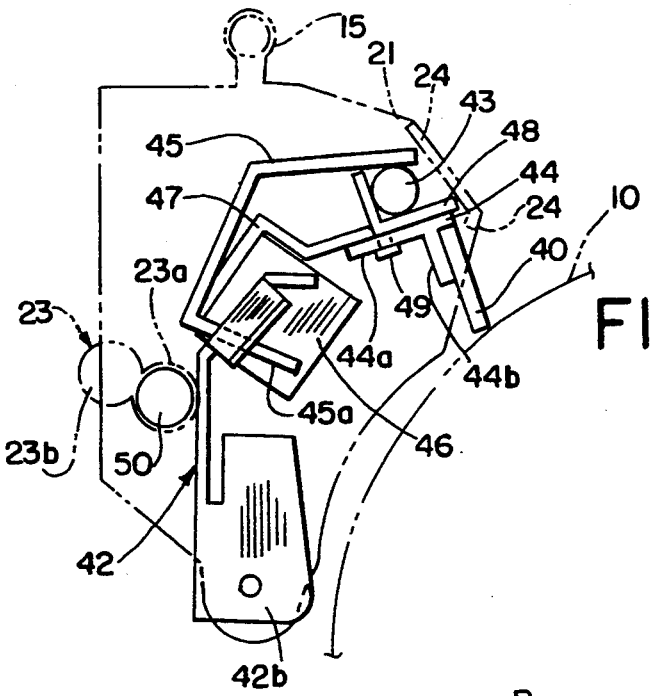
FIG. 2 is a front view of a positioning mechanism provided in the cleaning device of FIG. 1.

Above the fur brush 30, the cleaning blade 40 is extended over substantially an entire length of the photoconductive drum 10. As is shown in FIGS. 2 and 3, the cleaning blade 40 is connected to a blade shaft 43 supported in the housing 21 through a bracket 48 and a blade bearing member 44. The bracket 48 has an L-shaped cross section so as to cover a side area and a bottom area of the blade shaft 43, the side area being farther from the photoconductive drum 10 than another side circumferential area thereof. The bracket 48 is extended over substantially an entire length of the blade shaft 43. The blade bearing member 44 includes an attaching plate 44*a* in contact with substantially an entire area of a bottom portion of the bracket 48 which covers the bottom area of the blade shaft 43, and a supporting plate 44*b* extended substantially vertically toward the photoconductive drum 10 from a longitudinal perimeter of the attaching plate 44*a* which is closer to the photoconductive drum 10 than another longitudinal perimeter thereof. The cleaning blade 40 is attached on the supporting plate 44*b*.

As is shown in FIG. 2, a central portion of the blade bearing member 44 in a longitudinal direction thereof is attached to a central portion of the bracket 48 in a longitudinal direction thereof by a bolt 49, whereby the blade bearing member 44 is fixed on the bracket 48. At the central portion of the bracket 48, a base of an arm 47 is attached so as to be extended away from the photoconductive drum 10. At a tip of the arm 47, a weight 46 is attached. The weight 46 biases the cleaning blade 40 toward the photoconductive drum 10 with the blade shaft 43 as a pivoting center. The longitudinal perimeter of the bracket 48 closer to the photoconductive drum 10 is in contact with the cover 24 covering the upper portion of the opening 21*a*. Thus, a tip of the cleaning blade 40 is in pressure contact with the surface of the photoconductive drum 10.

Figure 4:
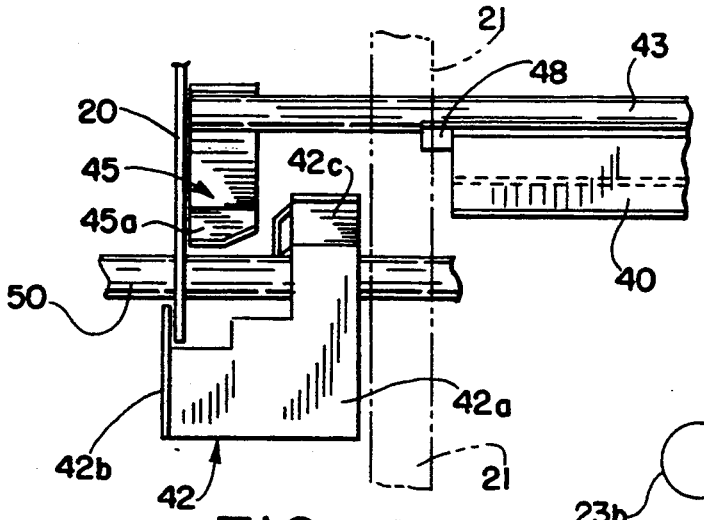
FIG. 4 is a side view of the positioning mechanism of FIG. 2 seen from a photoconductive drum.

In a front section of the copier, a front end of the blade shaft 43 is extended out of the housing 21 to be fixed between the housing 21 and the fixed plate 20. At a tip portion of the blade shaft 43 disposed outside the housing 21, a pivoting lever 45 is attached. The pivoting lever 45 is a rectangular plate bent along two lines. An end of the pivoting lever 45 is attached on a top area of the blade shaft 43. The pivoting lever 45 is then extended away from the photoconductive drum 10 in a substantially horizontal state, and bent downward. The bent portion of the pivoting lever 45 is further bent toward the photoconductive drum 10, and a leading tip thereof acts as an engaging portion 45*a*. As is shown in FIG. 4, the engaging portion 45*a* has a cutout at a side opposed to the housing 21.

Below the engaging portion 45*a* of the pivoting lever 45, a positioning shaft 50 is provided which runs through the housing 21 in a horizontal state. The positioning shaft 50 is slidable in an axial direction with respect to the housing 21. To the positioning shaft 50, the operating member 42 is attached in a substantially vertical state in the vicinity of the pivoting lever 45. The operating member 42 includes a plain main portion 42*a* adhered on a side area of the positioning shaft 50 which is closer to the photoconductive drum 10 from the other side area thereof, the stopper 42*b* extended perpendicular to the main portion 42*a* from a front end of the main portion 42*a*, and a slanted portion 42*c* extended toward the photoconductive drum 10 from an upper portion of the main portion 42*a*, the upper portion being adhered on the positioning shaft 50. The stopper 42*b* is disposed outside the fixed plate 20. The main portion 42*a* has a recess at a side opposed to the fixed plate 20 so that a bottom portion of the fixed plate 20 be placed in the recess. The slanted portion 42*c* is disposed between the housing 21 and the engaging portion 45*a* of the pivoting lever 45. The slanted portion 42*c* has a bent portion which is extended from a front side thereof opposed to the fixed plate 20 in a slanted state toward the fixed plate 20 and the photoconductive drum 10. When the positioning shaft 50 is slid in a direction opposite from a direction of an arrow B (FIG. 3), the bent portion of the slanted portion 42*c* is put into and engaged with the cutout of the engaging portion 45*a* of the pivoting lever 45. When the positioning shaft 50 is further slid in the aforementioned direction, the slanted portion 42*c* contacts the engaging portion 45*a* to raise the engaging portion 45*a*. As a result, the blade shaft 43 in contact with the pivoting lever 45 is pivoted away from the photoconductive drum 10.

Since the bottom portion of the fixed plate 20 is placed in the recess of the main portion 42*a* of the operating member 42, the sliding movement of the positioning shaft 50 is restricted by the recess.

The positioning shaft 50 includes a main portion opposed to the photoconductive drum 10 and a small portion 56 connected to the main portion at a position closer to the front face of the copier with respect to the operating member 42. The small portion has a smaller diameter than that of a main portion. A medium portion 55 having a diameter smaller than that of the main portion but larger than that of the small portion 56, is connected to a front end of the small portion 56. A large portion 58 having an identical diameter with that of the main portion, is connected to a front end of the medium portion 55. A rear tip portion of the positioning shaft 50 is a tapered portion **50*b*. The diameter of the tapered portion 50*b*** becomes gradually smaller toward a rear end thereof.

Figure 5:
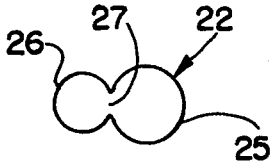
FIG. 5 is a view of a positioning hole formed in a fixed plate provided in a front section of the positioning mechanism of the cleaning device of FIG. 1.

As is shown in FIG. 1, the fixed plate 20 has a positioning hole 22, through which the front end of the positioning shaft 50 is inserted. The rear plate 29 has a positioning hole 23 (FIG. 6), through which the rear end of the positioning shaft 50 is inserted. As is shown in FIG. 5, the positioning hole 22 includes a large-sized circular portion 25 and a medium-sized circular portion 26. The large-sized circular portion 25 is closer to the photoconductive drum 10 than the medium-sized circular portion 26. The large-sized circular portion 25 has a substantially identical diameter with that of the main portion and the large portion 58 of the positioning shaft 50, for allowing any part of the positioning shaft 50 to pass therethrough. The medium-sized circular portion 26 has a substantially identical diameter with that of the medium portion 55 of the positioning shaft 50, for allowing the medium portion 55 to pass therethrough. The large-sized circular portion 25 and the medium-sized circular portion 26 are connected to each other by a connecting portion 27 having a width which is sufficiently large to allow only the small portion 56 to pass therethrough.

Figure 6:
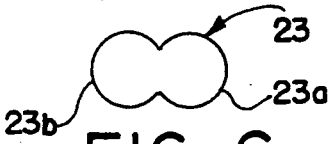
FIG. 6 is a view of another positioning hole formed in a plate provided in a rear section of the positioning mechanism of the cleaning device of FIG. 1.

As is shown in FIG. 6, the positioning hole 23 includes two engaging holes **23*a* and 23*b*, each of which has a substantially identical diameter with that of the main portion and the large portion 58 of the positioning shaft 50, for allowing the positioning shaft 50 inserted from the tapered portion 50*b* to pass therethrough. The engaging holes 23*a* and 23*b* are arranged in such a direction as to allow the positioning shaft 50 inserted therethrough to approach to and be distanced from the photoconductive drum 10. The engaging holes 23*a* and 23*b* are connected to each other by a connecting portion having a smaller width than that of the diameter of the engaging holes 23*a* and 23*b*. The engaging hole 23*a* is closer to the photoconductive drum 10 than the engaging hole 23*b***.

As is shown in FIG. 3, an idle gear 51 is rotatably engaged with a rear part of the positioning shaft 50. The idle gear 51 is rotated when being engaged with an input gear (not shown), to which a driving force from a driving source of the main body of the copier is conveyed. The idle gear 51 is biased toward the rear face of the copier by a spring 57 engaged with the positioning shaft 50. The idle gear 51 is engaged with a subordinate gear 52 which is fixed at a rear part of the rotation shaft 31 of the fur brush 30. The rotation shaft 31 is rotated by rotation of the subordinate gear 52. As is shown in FIG. 1, the rotation shaft 31 has an intermediate gear 53 fixed at a front part thereof. The intermediate gear 53 is engaged with a conveying gear 54 fixed at the spiral conveyor 34. Accordingly, rotation of the rotation shaft 31 is conveyed to the spiral conveyor 34, thereby rotating the spiral conveyor 34.

When the copier is in operation, the cleaning device having the above-mentioned construction is operated in the following manner. As is shown in FIG. 3, the positioning shaft 50 is entirely moved forward (oppositely from the direction of the arrow B), and the tapered portion **50*b* can move between the two engaging holes 23*a* and 23*b* through the connecting portion. At this point, the small portion 56 of the positioning shaft 50 is placed in the positioning hole 22. When the small portion 56 is put into the large-sized circular portion 25 of the positioning hole 22, the tapered portion 50*b* is put into the engaging hole 23*a*. Then, the positioning shaft 50 is moved rearward as is shown by the arrow B. The tapered portion 50*b* passes through the engaging hole 23*a*, and the large portion 58 of the positioning shaft 50 is put into the large-sized circular portion 25. The positioning shaft 50 is thus positioned in this state. By this movement, the housing 21 supported by the supporting shaft 15 is positioned in such a position as to put the fur brush 30 into contact with the photoconductive drum 10**.

At this point, as is shown in FIG. 4, the slanted portion **42*c* of the operating member 42 is out of contact from the engaging portion 45*a* of the pivoting lever 45, and the blade shaft 43 is pivoted toward the photoconductive drum 10 by the weight 46. The longitudinal perimeter of the bracket 48 closer to the photoconductive drum 10 is put into contact with the cover 24 of the housing 21, and the tip of the cleaning blade 40 is put into pressure contact with the surface of the photoconductive drum 10**.

In this state, the idle gear 51 is pressed by the spring 57 to be engaged with the subordinate gear 52. Rotation of the idle gear 51 which receives a driving force of the main body of the copier is conveyed to the rotation shaft 31 of the fur brush 30, thereby rotating the fur brush 30. The rotation of the fur brush 30 is conveyed to the spiral conveyer 34 through the intermediate gear 53 and the conveying gear 54, thereby rotating the spiral conveyer 34. Since the ends of the positioning shaft 50 are positioned in the positioning holes 22 and 23 (namely, the large-sized circular portion 25 and the engaging portion **23*a*), axes of the idle gear 51 and the input gear have a specified distance therebetween. Therefore, there is no possibility that the idle gear 51** is irregularly rotated.

As is described above, the cleaning blade 40 is slid along and the fur brush 30 is rotated against the surface of the photoconductive drum 10 while being in pressure contact therewith. Accordingly, the surface of the photoconductive drum 10 which is rotating is cleaned by the fur brush 30 and the cleaning blade 40.

The cleaning device is operated in the following way when the copier is transported or stored.

The positioning shaft 50 is slid forward, thereby placing the tapered portion **50*b* in the engaging hole 23*a* of the positioning hole 23. At this point, the fixed plate 20 contacts a perimeter of the recess, thereby preventing further forward movement of the positioning shaft 50. Accordingly, there is no possibility that the tapered portion 50*b* comes out of the engaging hole 23*a*. In this state, the small portion 56 of the positioning shaft 50 is placed in the large-sized circular portion 25 of the positioning hole 22. Then, the positioning shaft 50 is moved away from the photoconductive drum 10 with the small portion 56 moving into the connecting portion 27**.

Figure 7:
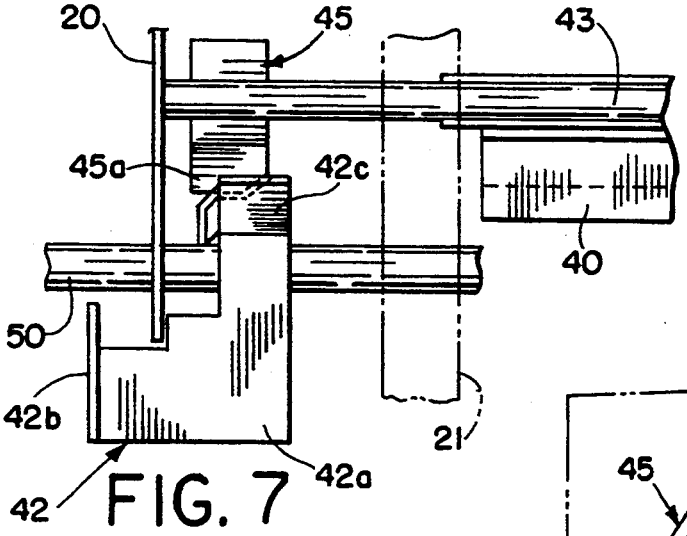
FIG. 7 is a side view of the positioning mechanism of FIG. 2 seen from a photoconductive drum illustrating a positioning operation thereof.
Figure 8:
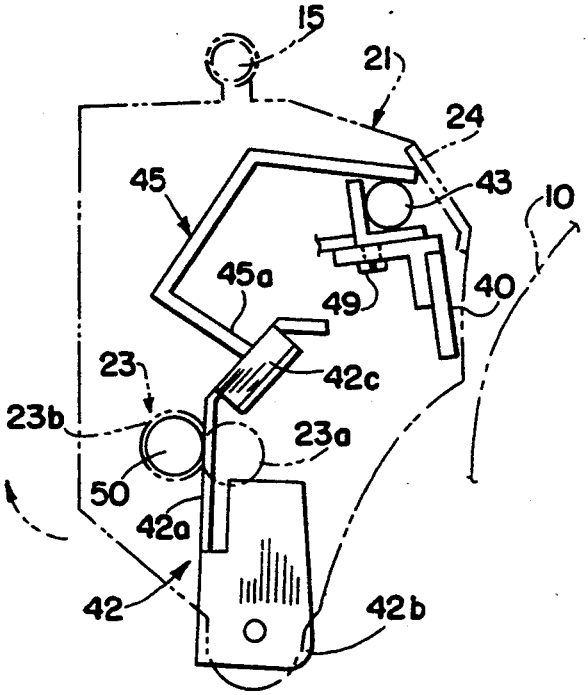
FIG. 8 is a front view of the positioning mechanism of FIG. 2 in the state of FIG. 7.

When the small portion 56 is put into the medium-sized circular portion 26, the tapered portion 50*b* is put into the engaging hole 23*b*. When the positioning shaft 50 is pressed forward in this state, the bent portion of the operating member 42 comes into engagement with the cutout of the engaging portion 45*a* of the pivoting lever 45, and then the engaging portion 45*a* runs into the slanted portion 42*c* as is shown in FIG. 7. By this movement, the pivoting lever 45 is pivoted away from the photoconductive drum against the weight 46 with the blade shaft 43 as a pivoting center, whereby the tip of the cleaning blade 40 attached to the blade shaft 43 through the bracket 48 is separated from the surface of the photoconductive drum 10. Then, the medium portion 55 of the positioning shaft 50 is positioned in the medium-sized circular portion 26 of the positioning hole 22 farther from the photoconductive drum 10, while the engaging portion 45*a* of the pivoting lever 45 stays on the slanted portion 42*c* of the operation member 42.

Along with this positioning of the positioning shaft 50 away from the photoconductive drum 10, the screws 18*a* and 18*b* are also moved away from the photoconductive drum 10 in the slots 17*a* and 18*b*. Accordingly, the housing 21 is entirely moved away from the photoconductive drum 10 together with the blade shaft 43. As a result, the fur brush 30 supported in the housing 21 and the cleaning blade 40 connected with the blade shaft 43 are also moved away from the photoconductive drum 10.

When the medium portion 55 of the positioning shaft 50 is positioned in the medium-sized circular portion 26, the idle gear 51 engaged with the positioning shaft 50 is disengaged from the subordinate gear 52. Accordingly, there is no possibility that a driving force of the copier is conveyed to the subordinate gear 52.

Figure 9:
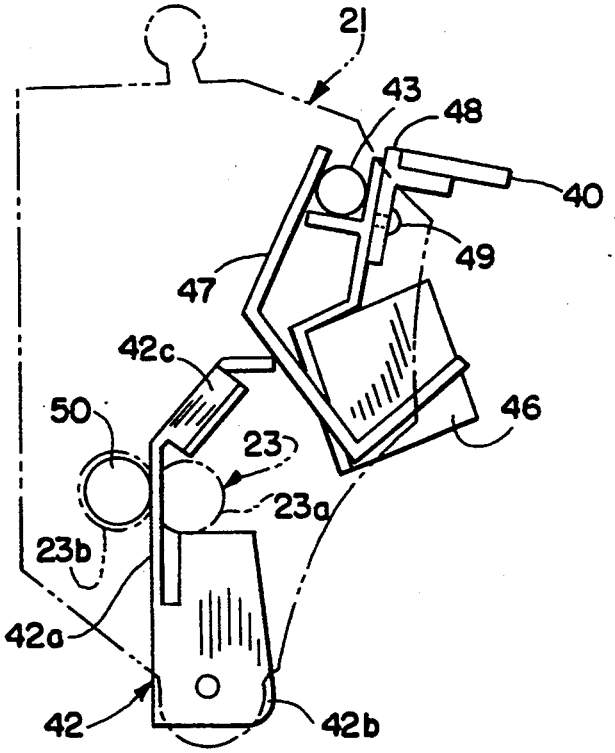
FIG. 9 is a front view of the positioning mechanism of FIG. 2 illustrating another positioning operation thereof.

In the case the cleaning blade 40 is replaced with a new one in this state, the cleaning device is entirely detached from the main body of the copier, and the cover 24 covering the upper portion of the opening 21*a* is detached. The positioning shaft 50 is slid in the direction of the arrow B so as to put the large portion 58 in the large-sized portion 25 of the positioning hole 22. By this movement, as is shown in FIG. 4, the slanted portion 42*c* of the operating member 42 is put out of contact from the engaging portion 45*a* of the pivoting lever 45. Then, the pivoting lever 45 is pivoted by the weight 46. The pivoting of the pivoting lever 45 pivots the blade shaft 43. In this case, since the cover 24 is detached from the housing 21, the pivoting lever 45 and the blade shaft 43 are pivoted to be in the state shown in FIG. 9 by the weight 46. As a result, the cleaning blade 40 attached to the blade shaft 43 through the bracket 48 is put out of the housing 21 through the opening 21*a*. Then, when the housing 21 is entirely slanted so that the opening 21*a* is open upward, the bolt 49 which attaches the blade bearing member 44 connected with the cleaning blade 40 to the bracket 48 is visually recognized from above. The bolt 49 is disengaged by a driver to replace the cleaning blade 40 with a new one.

Before a copier equipped with the aforementioned cleaning device is used for the first time, toner is adhered on the cleaning blade 40 before an image forming process is started. This is performed in order to protect the cleaning blade 40 from being curved by direct sliding thereof along the surface of the photoconductive drum 10. For adhering toner on the cleaning blade 40, the ends of the positioning shaft 50 are put in the medium-sized circular portion 26 and the engaging hole 23*b* to entirely move the housing 21 away from the photoconductive drum 10. In this state, the copier is operated and toner is adhered entirely on the surface of the photoconductive drum 10.

Then, as is shown in FIG. 1, the ends of the positioning shaft 50 are put into the large-sized circular portion 25 and the engaging portion 23*a*, and the large portion 58 is positioned in the large-sized circular portion 25. Thus, as is shown in FIG. 4, the slanted portion 42*c* of the operating member 42 is put out of contact from the engaging portion 42*a* of the pivoting lever 45, and the blade shaft 43 is pivoted by the weight 46 toward the photoconductive drum 10. Then, the longitudinal perimeter of the bracket 48 closer to the photoconductive drum 10 contacts the cover 24 of the housing 21, whereby the tip of the cleaning blade 40 is put into pressure contact with the surface of the photoconductive drum 10. When the photoconductive drum 10 is rotated again in this state, the toner adhered on an area of the surface of the photoconductive drum 10 opposed to a portion between the cleaning blade 40 and the fur brush 30 is adhered on the cleaning blade 40 while being scratched off by the cleaning blade 40. The toner adhered on the other area of the photoconductive drum 10 is removed by the fur brush 30 and the cleaning blade 40. Thus, toner is adhered on the cleaning blade 40, and the photoconductive drum 10 is smoothly cleaned by the fur brush 30 and the cleaning blade 40 after that.

As has been described, in an image forming apparatus including a positioning mechanism according to the present invention, there is no possibility that the photoconductive drum is damaged by the cleaning blade when the image forming apparatus is not used.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A positioning mechanism for a cleaning device, comprising:

a housing supported at a top portion thereof by a supporting shaft parallel to a photoconductive drum of an image forming apparatus, to be pivotal about the supporting shaft with respect to a main body of the image forming apparatus;

a blade shaft supported in the housing to be parallel to the photoconductive drum and to be pivotal with respect to the housing;

a cleaning blade attached to the blade shaft to be opposed to a circumferential surface of the photoconductive drum;

a brush member provided in the housing to be parallel to the cleaning blade in a rotating direction of the photoconductive drum and to be integrally pivotal with the housing;

positioning means for controllably positioning the housing at a position close to the photoconductive drum and at another position far from the photoconductive drum; and moving means for moving the cleaning blade away from the photoconductive drum relative to the movement of the housing when the housing is moved by the positioning means to the position far from the photoconductive drum.

2. A positioning mechanism for a cleaning device according to claim 1, wherein the brush member is a fur brush.

3. A positioning mechanism for a cleaning device, comprising:

a housing supported at a top portion thereof by a supporting shaft parallel to a photoconductive drum of an image forming apparatus, to be pivotal about the supporting shaft with respect to a main body of the image forming apparatus;

a blade shaft supported in the housing to be parallel to the photoconductive drum and to be pivotal with respect to the housing;

a cleaning blade attached to the blade shaft to be opposed to a circumferential surface of the photoconductive drum;

a brush member provided in the housing to be parallel to the cleaning blade in a rotating direction of the photoconductive drum and to be integrally pivotal with the housing;

positioning means for controllably positioning the housing at a position close to the photoconductive drum and at another position far from the photoconductive drum; and moving means for moving the cleaning blade away from the photoconductive drum relative to the movement of the housing when the housing is moved to the position far from the photoconductive drum by the positioning means, wherein the positioning means includes:

a positioning shaft running throughout the housing to be parallel to the blade shaft and supported at ends thereof by plate members which are provided in the main body of the image forming apparatus; and positioning holes respectively formed in the plate members to allow the ends of the positioning shaft to pass therethrough, so as to controllably position the positioning shaft at a position close to the photoconductive drum and at another position far from the photoconductive drum.

4. A positioning mechanism for a cleaning device according to claim 3, wherein the positioning shaft includes a large portion having a substantially identical diameter with a main portion of the positioning shaft disposed in the housing, a medium portion having a diameter smaller than diameter of the large portion, and a small portion having a diameter smaller than the diameter of the medium portion, the large portion, the medium portion, and the small portion being serially connected one after another in the above order from an end of the positioning shaft; and further includes a tapered portion at an opposite end thereof having a diameter which gets smaller and smaller toward a tip of the opposite end.

wherein one of the positioning holes includes a large-sized portion, a medium-sized portion, and a connecting portion connecting the large-sized portion and the medium-sized portion, the large-sized portion being disposed closer to the photoconductive drum than the medium-sized portion, the large-sized portion being sufficiently large to allow the large portion of the positioning shaft to pass therethrough, the medium-sized portion being too small to allow the large portion of the positioning shaft to pass therethrough but sufficiently large to allow the medium portion of the positioning shaft to pass therethrough, and the connecting portion being sufficiently large to allow only the small portion of the positioning shaft to pass therethrough, and wherein the other positioning hole includes a pair of engaging portions connected to each other, the engaging portions each being sufficiently large to allow the main portion of the positioning shaft to pass therethrough, one of the engaging portions being closer to the photoconductive drum than the other engaging portion.

5. A positioning mechanism for a cleaning device according to claim 3, wherein the moving means comprises:

an operating member attached to the positioning shaft to be integrally movable with the positioning shaft in axial direction of the positioning shaft; and a pivoting member having a first end which is attached to an end of the blade shaft, and a second end which is put into engagement with the operating member in accordance with the movement of the positioning shaft in the axial direction thereof, so sa to pivot the blade shaft.

6. A positioning mechanism for a cleaning device according to claim 5.

wherein the positioning shaft is engaged with a rotatable idle gear for receiving a driving force in the vicinity of one of the ends of the positioning shaft, and wherein the brush member has a shaft running therethrough and rotatably supported by the housing, and the shaft is engaged with a subordinate gear attached at an end thereof, the subordinate gear being put into engagement with the idle gear when the positioning shaft is positioned at the position close to the photoconductive drum.

* * * * *